United States Patent [19]

DeChamp et al.

[11] Patent Number: 4,600,263

[45] Date of Patent: Jul. 15, 1986

[54] COAXIAL CONNECTOR

[75] Inventors: David W. DeChamp; Clarence L. Clayatt, III, both of Phoenix, Ariz.

[73] Assignee: ITT Corporation, New York, N.Y.

[21] Appl. No.: 581,462

[22] Filed: Feb. 17, 1984

[51] Int. Cl.[4] ..... H01R 17/18

[52] U.S. Cl. ..... 339/177 R; 339/255 R

[58] Field of Search ..... 339/255, 256, 258, 177 R, 339/177 E, 276 R

[56] References Cited

U.S. PATENT DOCUMENTS

| | | | |
|---|---|---|---|
| 3,406,373 | 10/1968 | Forney, Jr. | 339/177 R |
| 3,603,912 | 9/1971 | Kelly | 339/177 R |
| 3,781,762 | 12/1973 | Zuackenbush | 339/177 R |
| 4,173,385 | 11/1979 | Fenn et al. | 339/177 E |
| 4,280,749 | 7/1981 | Hemmer | 339/177 R |

FOREIGN PATENT DOCUMENTS

| | | | |
|---|---|---|---|
| 1540617 | 1/1970 | Fed. Rep. of Germany | 339/177 R |
| 2405885 | 8/1975 | Fed. Rep. of Germany | 339/177 R |
| 2396440 | 3/1979 | France | 339/177 R |
| 695439 | 12/1953 | United Kingdom | 339/177 E |

*Primary Examiner*—Gil Weidenfeld
*Assistant Examiner*—David L. Pirlot
*Attorney, Agent, or Firm*—T. L. Peterson; R. C. Turner

[57] ABSTRACT

A coaxial connector having precise matched impedance characteristics which is suitable for use with coaxial cable having a very soft dielectric core. A slotted bushing is fit over the core of the cable. The bushing is inserted into the rear of the coaxial contact assembly. A flange on the front of the bushing snaps into a recess in the wall of the coaxial contact assembly to provide a positive interlock and establish an optimum electrical path in the outer conductor circuit for high frequency performance. A sleeve is crimped down around the outer conductor of the cable which is laid over an exposed, rigid rear portion of the bushing and the rear of the coaxial contact assembly, neither of which is deformed during the crimping operation.

13 Claims, 8 Drawing Figures

COAXIAL CONNECTOR

BACKGROUND OF THE INVENTION

The present invention relates generally to an electrical connector and, more particularly, to a connector for a coaxial cable which has precise matched impedance characteristics over the cable termination section of the connector.

It is known in the art of coaxial cable terminations to utilize a metal sleeve around the cable dielectric which functions as a support during insertion of the cable into the coaxial contact assembly of the termination. Typically in such arrangements the metal sleeve does not provide a predictable electrical path through the termination so that the matched impedance characteristics of the termination are compromised, which can result in RF signal losses occurring at higher frequencies, on the order of one GHZ and above.

U.S. Pat. Nos. 3,701,086 and 4,340,269 disclose coaxial connectors having metal sleeves which are fit between the inner dielectric core of the coaxial cable and the outer conductor or braid of the cable. An outer sleeve is then crimped down around the outer conductor and inner sleeve to provide a secure electrical connection between the cable outer conductor and the conductive shell of the connector. In these arrangements, the inner sleeve over which the outer conductor of the cable is laid is relatively thin, and is crimped when the outer sleeve is crimped onto the outer conductor, resulting in both the outer conductor of the cable and the inner sleeve being deformed. As a consequence, the outer conductor of the cable and inner sleeve no longer have the desired circular configuration required for exact matched impedance characteristics, which depend in part upon the inner diameter of the outer conductor and the outer diameter of the center conductor to be carefully maintained in distance, circular configuration and concentricity. Further, the points of positive electrical contact among the sleeve, cable braid, and coaxial contact assembly may not be in the required locations for optimum high frequency performance. If the coaxial cable utilizes a very soft dielectric core, the problem of maintaining a matched impedance over the termination region of the cable with the coaxial connector assembly is even more difficult because the outer conductor of the cable will deform more readily when the outer sleeve is crimped down over the outer conductor of the cable onto the inner sleeve.

U.S. Pat. No. 3,196,382 discloses a coaxial cable connector in which the sleeve inserted between the dielectric core and the outer conductor of the cable is a rigid bushing which is not deformed during the crimping operation so that the shape of the sleeve is not altered. However, during the crimping operation it is possible that bushing may shift axially so that the forward end of the sleeve may become spaced behind a step in the interior of the connector shell. To obtain matched impedance at high frequencies it is critical that there be a good electrical contact between the forward end of the bushing and the shell, and that the front of the bushing be precisely aligned or flush with said step in the shell. A RF signal travels along the surface of a conductor. In the case of a series of conductors, this means that the signal travels along the conductive surface from contact point to contact point rather than through the conductors as with conventional power or low frequency signal. If the contact points are not arranged to create an optimum surface path in the outer conductor circuit, usually the minimum possible surface length through the section, excessive inductance and/or resistance are introduced in the outer circuit causing RF signal loss. The electric field emanating from the surface of the center conductor circuit also "sees" the total length of the outer conductor from contact point to contact point and is affected by it. Although additional counterbores or steps in the outer circuit may not add length, these features introduce sections of unmatched impedance and capacitance which also cause RF signal loss. Sensitivity of the RF signal to all of these conditions increases with frequency; therefore, the more of these conditions present and the higher the frequency, the greater the RF signal loss. Because the bushing in the coaxial connector disclosed in U.S. Pat. No. 3,196,382 is capable of moving axially, the connector may not have the degree of matched impedance required for high frequency applications.

It is the object of the present invention to provide an improved coaxial connector termination which has precise matched impedance characteristics over the termination region of the assembly.

SUMMARY OF THE INVENTION

According to a principal aspect of the present invention, there is provided an electrical connector member for a coaxial cable which incorporates a bushing which is slid over the dielectric core of the coaxial cable. The bushing has a relatively rigid rear portion and a slotted forward portion having a flange on its front end. The outer conductor of the cable is laid over the rigid rear portion of the bushing. The center contact of the connector is connected to the center conductor of the cable. The cable with the bushing and center contact thereon is then inserted into the rear of the coaxial contact assembly of the connector member until the flange on the front of the bushing snaps into a recess in the interior of the coaxial contact assembly. This arrangement provides a positive interlock between the parts preventing movement of the bushing in opposite axial directions, and also provides a positive contact point between the bushing and the shell of the coaxial contact assembly at the desired critical location in the connector shell. Thereafter an outer sleeve is crimped down around the outer conductor of the cable in the region of the rigid rear portion of the bushing which is exposed behind the rear of the connector shell. By the foregoing combination of features the termination assembly of the invention will have a precise matched impedance characteristic throughout the termination region of the assembly.

DESCRIPTION OF THE PREFERRED EMBODIMENT

Figure 1:
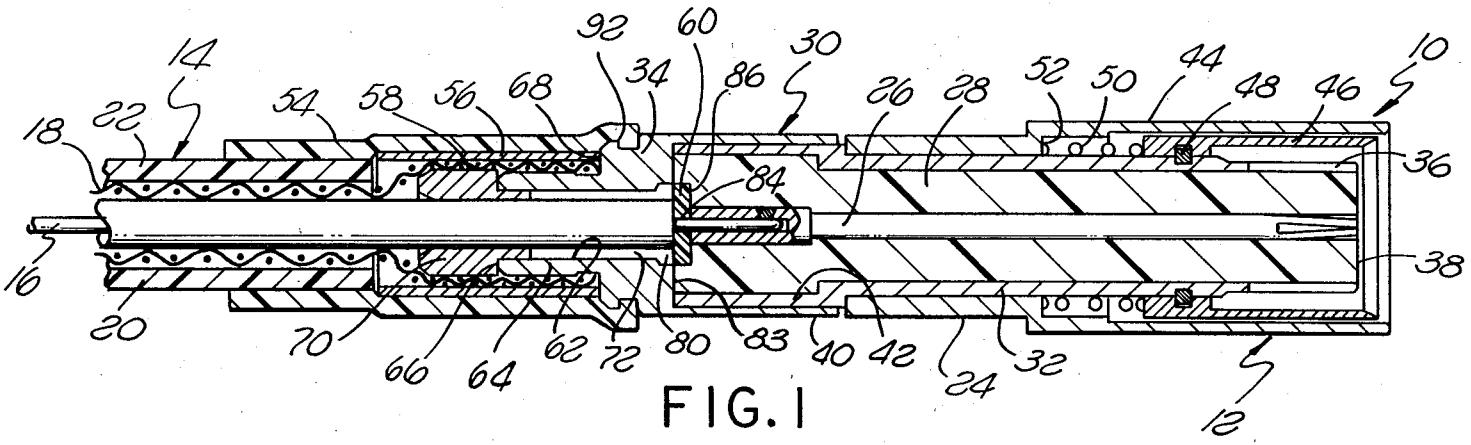
FIG. 1 is a partial longitudinal sectional view through the coaxial cable termination of the present invention.

Referring now to the drawings in detail, there is illustrated in FIG. 1 the coaxial cable termination of the present invention, generally designated 10, which comprises an electrical connector member 12 which is connected to a coaxial cable 14. The cable 14 has a center conductor 16 surrounded by an inner dielectric jacket or core 18. An outer conductor or braid 20, which functions as the center conductor shield, surrounds the core 18. An outer dielectric jacket 22 surrounds the outer conductor 20. Because of the novel features of the termination of the present invention the cable 14 requires a relatively soft dielectric core 18, which is generally unsuitable for a precise matched impedance termination when conventional termination techniques are utilized. Such a cable having a soft dielectric core is a cable manufactured by W. L. Gore & Associates, Inc., Newark, Del. designated 95 Ω CXN-1458 cable.

The electrical connector member 12 which is connected to the cable 14 comprises a coaxial contact assembly 24 including a center contact 26 mounted within an insulator 28 which is surrounded by a metal shell 30. The shell 30 comprises a front part 32 and a rear part 34. The front part 32 is slotted, as indicated at 36, adjacent to the forward mating end 38 of the coaxial contact assembly providing the outer contact of the assembly. The outer contact, insulator 28 and center contact 26 terminate at the forward mating end 38 of the assembly. The cylindrical forward portion 40 of the rear part of the metal shell 30 is telescopically fit over the rear portion 42 of the front part 32. The two parts are secured together by press fitting together.

A sleeve 44 surrounds the forward portion of the shell 30. A collar 46 inside the sleeve 44 is fixed to the front part 32 of the shell by a retaining ring 48. A coil spring 50 bearing against the rear of the collar 46 and a forwardly facing shoulder 52 on the sleeve 44 biases the sleeve rearwardly. The spring 50 assures a positive abutting force at the coaxial contact interface of the connector member 10 with the mating connector member, not shown.

Figure 2:
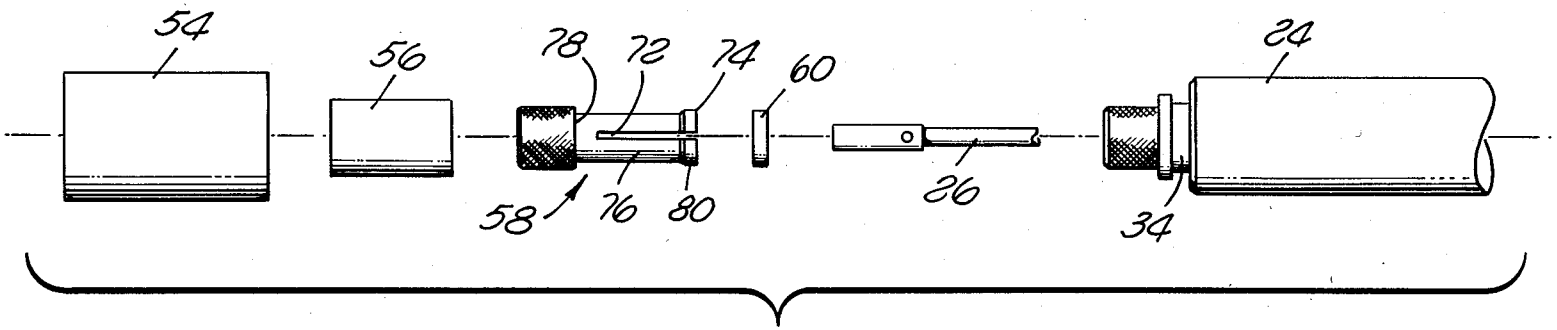
FIG. 2 is an exploded view showing the principal parts of the electrical connector member of the present invention utilized in the termination illustrated in FIG. 1.

The cable 14 is connected to the coaxial contact assembly 24 by means of a plastic shrink sleeve 54, a metal crimp sleeve 56, a slotted bushing 58 and a plastic thrust ring or bead 60, which are shown disassembled in FIG. 2. The bushing 58 is mounted in a cylindrical bore 62 in the rear part 34 of the shell 30. The rear part of the shell embodies a reduced diameter rigid rear termination end 64 which extends forwardly from the annular rear surface 66 of the rear part to a rearwardly facing annular shoulder 68 on the rear part of the shell. The bushing has an enlarged rear portion 70 which is sufficiently rigid that it will not become deformed when the crimp sleeve 56 is crimped around the rear portion of the bushing and the rear termination end 64 of the shell 30.

The forward portion of the bushing is formed with a plurality of longitudinally extending slots 72 which extend from the front 74 of the bushing rearwardly but short of the rear portion 70 thereof. There may be provided four of such slots, by way of example only, which define four radially resilient fingers 76 therebetween. The enlarged rear portion 70 of the bushing provides a forwardly facing annular shoulder 78 which abuts against the rear surface 66 of the shell 30 when the bushing is fully mounted within the bore 62. The forward portion of the bushing defined by the resilient finger 76 is dimensioned to have a clearance fit within the bore 62, preferably about 0.003 inch or greater clearance. Radially outwardly extending flanges 80 are formed on the forward ends of the fingers 76 which fit within an annular recess or groove 82 formed in the rear part of the shell 30. The recess 82 is actually a counterbore for the bore 62. The counterbore opens at bottom 83 of the recess formed by the cylindrical forward portion 40 of the rear part 34. The front ends of the fingers of the bushing 58 are flush with the surface 83 which is the critical step point in the shell assembly. The axial length of the flanges is essentially the same as the depth of the counterbore 82 so that the flanges substantially completely fill the counterbore. Thus, the bushing 58 and rear termination end 64 of the shell simulate electrically a one-piece conductive element, thereby assuring electrical continuity between the outer conductor of the cable and the outer contact of the coaxial contact assembly. The flanges 80 also provide a fixed, positive electrical engagement at the critical step point 83 in the assembly.

The thrust bead 60 has a center bore 84 which slidably receives the center conductor 16 of the cable. The ring fits within a counterbore 86 in the rear of the insulator 28. The bead fits tightly between the bottom of the counterbore and the front 74 of the bushing. Preferably the outer surface of the rear portion 70 of the bushing, and the outer surface of the rear termination end 64 of the shell 30, are knurled to enhance the securement of the outer conductor of the cable to the bushing and shell 30 by the crimp sleeve 56.

Figure 3:
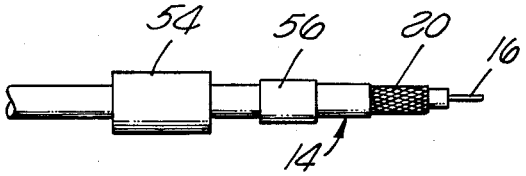
FIGS. 3 to 8 illustrate the various steps utilized in making the termination illustrated in FIG. 1.
Figure 4:
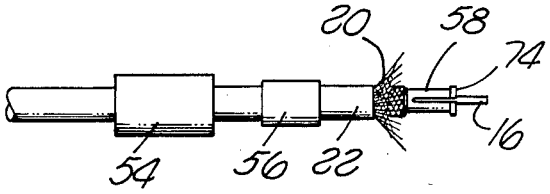
Figure 5:
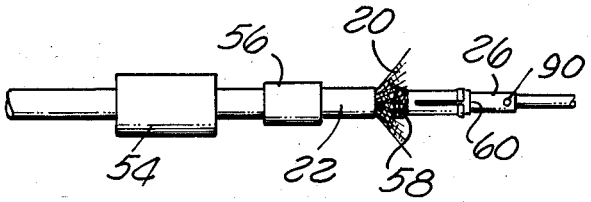
Figure 6:
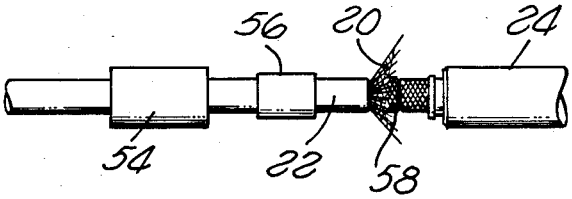
Figure 7:
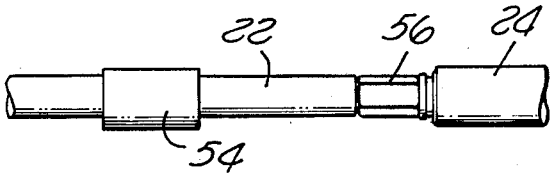
Figure 8:
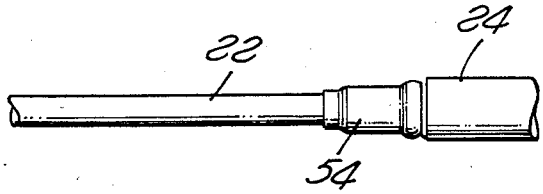

Reference is now made to FIGS. 3 to 8 which illustrate the various steps utilized in forming the termination 10 of the present invention. As seen in FIG. 3, initially the cable is trimmed to expose short lengths of the center conductor 16 and the outer conductor 20. The shrink sleeve 54 and crimp sleeve 56 are slid rearwardly over the cable as shown. As seen in FIG. 4, the outer conductor braid 20 is flared outwardly, and the slotted bushing 58 is slid rearwardly onto the cable until the rear portion of the bushing butts up against the braid adjacent to the end surface of the outer dielectric jacket 22. It is noted that the center conductor 16 extends forwardly beyond the front 74 of the bushing. The plastic thrust bead 60 is then slipped over the center conductor until it abuts the forward end of the bushing and cable dielectric core. The rear of the center contact 26 is then pushed over the center conductor until it abuts against the thrust bead, and is soldered to the center conductor by introducing solder through an opening 90 in the wall of the center contact. The cable assembly thus formed is then inserted into the rear of the coaxial contact assembly 24, as seen in FIG. 6. The forward portion of the bushing is pushed into the bore 62 in the rear part of the shell 30. Because the fingers 76 forming the forward portion of the bushing are resilient, and the dielectric core 18 of the cable is soft, the fingers will deflect radially inwardly when the bushing is pushed into the bore. If necessary, the fingers may be squeezed slightly to facilitate insertion of the bushing into the bore. The bushing is pushed into the bore until the shoulder 78 thereon butts against the rear surface 66 of the rear termination end of the connector shell. When the flanges 80 on the forward ends of the fingers 76 reach the counterbore 82 upon pushing of the bushing into the bore 62, the flanges will snap outwardly into the counterbore to provide the required point of positive electrical contact and a positive interlock of the bushing to the shell of the connector assembly, thereby preventing movement of the bushing relative to the shell in opposite axial directions. As seen in FIG. 7, the crimp sleeve 56 is pushed forwardly over the outer conductor braid 20 of the coaxial cable until the sleeve butts against the shoulder 68 on the rear part of the connector shell. The sleeve 56 is then crimped, preferably with a hex crimp as shown, to tightly clamp the braid onto the rigid rear portion 70 of the bushing and the rear termination end 64 of the shell 30. Finally the shrink sleeve 54 is slid forwardly over the crimped sleeve 56 and over a flange 92 on the rear part 34 of the shell, and the sleeve is shrunk around the assembly by applying heat thereto in any suitable fashion thereby providing a sealed enclosure for the termination region of the final assembly.

Because the crimping operation does not result in the rear portion 70 of the bushing or the rear termination end 64 of the connector shell being deformed because of their rigidity, such parts maintain their circular configuration, and concentricity with respect to the center conductor of the cable, even though the dielectric core of the cable is relatively soft. Thus, no deformation of the metal sleeves surrounding the dielectric core occurs, which would impair the matched impedance characteristics of the termination.

The bushing 58 provides support for the soft dielectric core of the cable which facilitates insertion of the cable termination subassembly illustrated in FIG. 5 into the rear of the coaxial contact assembly 24. Thus, the bushing acts as a contact installation tool. Furthermore, the bushing provides continuation of the outer conductor circuit with the same impedance as the cable over the full length of the termination, and provides a positive contact interconnection with the connector shell at the critical point 83 by virtue of the positive interlock made between the flanges 80 on the resilient fingers of the bushing and the counterbore 82. The positive interlock is further enhanced by the positive engagement between the fowardly facing shoulder 78 on the bushing and the rear surface 66 on the rear part of the shell 30. The plastic bead 60 provides a thrust support for the center contact during installation of the contact onto the center conductor of the cable and during insertion of the cable termination subassembly into the rear of the coaxial contact assembly 24. The plastic bead is also a thrust support for center contact axial mating forces and provides a continuous dielectric medium through the termination region of the assembly, bridging the insulator 28 of the coaxial contact assembly 24 and the dielectric core of the cable. The foregoing features provide a precise impedance match of the termination to the conductors of the coaxial cable so that the termination of the invention may be utilized at high frequencies with minimal signal loss.

What is claimed is:

1. An electrical connector member particularly suited for use with a coaxial cable having a center conductor and an outer conductor separated by a relatively soft inner dielectric core comprising:

a conductive shell having a forward mating end and a rear termination end adapted to be connected to the outer conductor of the cable, said rear termination end having a bore therethrough and a rear annual surface;

an insulator in said shell containing a center contact adapted to be connected to the center conductor of the cable;

a hollow bushing having a front, a rear, a forward portion and a rear portion, said bushing being partially inserted into said bore from the rear of said sheel leaving said rear portion exposed, the outer conductor of the cable being adapted to be laid over said rear portion of said bushing;

said bore of said shell having an annular recess;

said rear portion of said bushing having a forward facing annular shoulder abutting said rear surface of said shell, and said forward end of said bushing having a radially deflectable flange engaging said annular recess thereby providing a positive interlock between said bushing and said shell; and a sleeve surrounding said rear portion of said bushing adapted to be crimped to secure the cable outer conductor to said bushing.

2. An electrical connector member as set forth in claim 1 wherein:

said bushing has a clearance fit within said bore.

3. An electrical connector member as set forth in claim 1 wherein:

said rear portion of said bushing is sufficiently rigid so as not to deform when said sleeve is crimped around the outer conductor of the cable laid over said bushing.

4. An electrical connector member as set forth in claim 1 wherein a longitudinally extending slot is provided in the wall of said bushing extending rearwardly from said front of said bushing whereby said forward portion of said bushing is radially contractible to provide additional positive interlock and a positive electrical contact point in said annular recess.

5. An electrical connector member as set forth in claim 4 wherein:

said bushing has a clearance fit within said bore to allow electrical continuity between said bushing and said shell at said point of positive electrical contact between said flange and said annular recess; and when said bushing is inserted from the rear into said bore said forward portion thereof contracts due to the engagement of said flange with the wall of said bore and the softness of the dielectric core of the cable, and said forward portion of said bushing expands outwardly when said flange reaches said recess whereby said flange will snap into said recess to interlock said bushing with said shell and create said point of positive electrical contact.

6. An electrical connector member as set forth in claim 4 wherein:

a plurality of said slots are provided in the wall of said bushing.

7. An electrical connector member as set forth in claim 1 wherein:

said shell has a forwardly facing surface thereon, said bore opening at said surface;

said recess is a counterbore in said forwardly facing surface; and the forward end of said bushing is flush with said forwardly facing surface.

8. An electrical connector member as set forth in claim 7 wherein:

said flange has an axial length substantially equal to the depth of said counterbore.

9. An electrical termination comprising:

an electrical connector member;

a coaxial cable having a center conductor and an outer conductor separated by a relatively soft inner dielectric core;

a conductive shell having a forward mating end and a rear termination end, said rear end being connected to the outer conductor of said cable, said rear end having a bore therethrough and a rear annular surface;

an insulator in said shell containing a center contact connected to the center conductor of said cable;

a hollow bushing haivng a front, a rear, a forward portion and a rear portion, said forward portion being partially inserted into said bore from the rear of said shell leaving said rear portion exposed, the outer conductor of said cable extending over said rear portion of said bushing;

said rear portion of said bushing having a forwardly facing annular shoulder abutting said rear surface;

said bushing having longitudinally extending slots in the wall thereof extending rearwardly from said front of said bushing whereby said forward portion of said bushing is radially contractible, and having an outwardly extending flange on said forward portion thereof;

an annular recess in said bore of said shell adapted to receive said flange therein to provide a positive interlock and a positive electrical contact point in said annular recess; and a sleeve surrounding said rear portion of said bushing and said outer conductor, said sleeve being crimped to secure said cable outer conductor to said bushing.

10. An electrical termination as set forth in claim 9 wherein:

said bushing has a clearance fit within said bore to allow electrical continuity between said bushing and said shell at said point of positive electrical contact between said flange and said annular recess; and when said bushing is inserted from the rear into said bore said forward portion thereof contracts due to the engagement of said flange with the wall of said bore thereby deforming said soft dielectric core, and said forward portion of said bushing expands outwardly when said flange reaches said recess whereby said flange snaps into said recess to interlock said bushing with said shell and create said point of positive electrical contact.

11. An electrical termination as set forth in claim 12 wherein:

said rear portion of said bushing is sufficiently rigid so as not to deform when said sleeve is crimped around the outer conductor of said cable.

12. An electrical termination as set forth in claim 9 wherein:

said shell has a forwardly facing surface thereon, said bore opening at said surface;

said recess is a counterbore in said forwardly facing surface; and the forward end of said bushing is flush with said forwardly facing surface.

13. An electrical termination as set forth in claim 12 wherein:

said flange has an axial length substantially equal to the depth of said counterbore.

* * * * *